United States Patent [19]

Sanderson et al.

[11] Patent Number: 4,621,515

[45] Date of Patent: Nov. 11, 1986

[54] METHOD AND APPARATUS FOR MAKING CIRCLIPS

[75] Inventors: Albert M. Sanderson, Penkridge; Arthur Pearson, Halesowen; David A. Bates, West Bromwich, all of England

[73] Assignee: George Salter & Co. Ltd., West Midlands, England

[21] Appl. No.: 556,240

[22] PCT Filed: Mar. 14, 1983

[86] PCT No.: PCT/GB83/00076

§ 371 Date: Nov. 10, 1983

§ 102(e) Date: Nov. 10, 1983

[87] PCT Pub. No.: WO83/03211

PCT Pub. Date: Sep. 29, 1983

[30] Foreign Application Priority Data

Mar. 12, 1982 [GB] United Kingdom ..... 8207347
Mar. 9, 1983 [EP] European Pat. Off. ..... 83301301.4

[51] Int. Cl.[4] ..... B21D 53/16; B21F 37/00

[52] U.S. Cl. ..... 72/403; 72/402; 72/339; 140/88

[58] Field of Search ..... 72/403, 402, 416, 384, 72/339; 140/88; 29/173; 411/517-519; 59/12, 18, 22; 24/563, 545

[56] References Cited

U.S. PATENT DOCUMENTS

| | | | |
|---|---|---|---|
| 496,773 | 5/1893 | Bowen | 59/22 |
| 948,615 | 2/1910 | Pratt | 140/88 |
| 1,526,518 | 2/1925 | Wentworth | 72/403 |
| 1,973,436 | 9/1934 | Hjort | 72/402 |
| 2,371,138 | 3/1945 | Harrison et al. | |
| 2,382,947 | 8/1945 | Brozer | 411/518 |
| 3,315,512 | 4/1967 | Maciorowski | 72/403 |

FOREIGN PATENT DOCUMENTS

| | | | |
|---|---|---|---|
| 30900 | 11/1922 | Denmark | 59/22 |
| 928644 | 6/1955 | Fed. Rep. of Germany | 140/88 |
| 1027016 | 3/1958 | Fed. Rep. of Germany | 29/173 |
| 1095051 | 12/1960 | Fed. Rep. of Germany | 411/517 |
| 3033783 | 4/1982 | Fed. Rep. of Germany | |
| 28387 | of 1904 | United Kingdom | 72/403 |
| 17299 | 1/1972 | United Kingdom | |

OTHER PUBLICATIONS

Marklew, J. J., "Circlip Production at Anderton Springs Ltd.," from *Machinery and Production Engineering*, Oct. 11, 1972.

*Primary Examiner*—Daniel C. Crane
*Attorney, Agent, or Firm*—Neil F. Markva

[57] ABSTRACT

Circlip making apparatus comprises three forming tools 2, 3, 4 equiangularly spaced about a mandrel axis 1*a*. A row of integral circlip blanks 6 are fed to the mandrel 1 through guide means 5 and blanks are cut from the row by blade 7 one by one before being bent into circlips around the mandrel 1 by advancement of the tools 2, 3, 4 radially of axis 1*a*. The row of blanks 6 is made from long flat wire stock and the stock is passed through work stations in which each blank is cut to tapered form and its cross-section planished between the ends so that it is adapted to a shape to be bent into a circlip without irregular distortion or buckling.

9 Claims, 13 Drawing Figures

METHOD AND APPARATUS FOR MAKING CIRCLIPS

FIELD OF THE INVENTION

This invention relates to a method and apparatus for making precision rings such as circlips, more especially circlips of a type having a generally annular appearance but with a gap defining two free ends and with a radially thick portion diametrically opposite the gap, the circlip diminishing in radial thickness from the raidally thick portion towards the ends to yield a smooth continuous tapered appearance between the ends and said thick portion.

BACKGROUND OF THE INVENTION

Circlips of the aforementioned type, hereinafter referred to as "of the type specified", may be used for positioning and retaining machine components internally in hollow bores or externally on shafts and have to meet accurate specifications. Such circlips are made by a stamping process by stampling out circlips from sheet metal. A problem with making circlips in this way is the large wastage of material necessarily incurred because the radial thickness of the circlip is small relative to the outer radius of the circlip. In some circlips (used for internal housing bores) the gap between the ends is wide enough for another circlip of the same type to pass through so that the circlips may be stamped out from sheet metal in interleaving fashion to reduce wastage, but even so wastage of material is still significant. Moreover, with some circlips (used for external shafts) the gap usually provided is too narrow even for this interleaving and so an even larger wastage is incurred.

It is an object of the present invention to provide apparatus and method to allow circlips of the type specified to be made in which the aforementioned wastage is alleviated and also in which the costs of production of circlips is reduced.

SUMMARY OF THE INVENTION

According to the present invention there is provided a method of making circlips of a type having a planar, generally annular appearance but with a gap defining two free ends and with a radially thick portion diametrically opposite the gap, the circlip diminishing in radial thickness from the radially thick portion towards the ends to yield a smooth, continuous tapered appearance between the ends and said thick portion, the method characterised by:

(a) making a longitudinal blank which blank is tapered from its middle portion towards its ends and of a shape which is configured to be formed into a circlip of the type specified by bending the blank, (b) bending the blank accurately around its middle portion on a mandrel so that the blank distorts during the bending operation in a controlled manner to make a circlip of the type specified, with the ends of the blank being shaped into the ends of the circlip and the middle portion of the blank being shaped into the radially thick portion.

Further according to the invention there is provided a longitudinal blank for a circlip of the type specified when made as described in the immediately preceding paragraph, and also a circlip of the type specified when made as described in the immediately preceding paragraph.

Still further according to the present invention there is provided a method of making circlips of the type specified, the method comprising:

(a) performing a series of discrete work operations on integral lengths of, preferably flat, wire or strip to adapt the profile or contour of each successive length of wire or strip in successive stages as the wire is moved relative to work stations at which said operations take place, so that longitudinal blanks are formed successively form successive lengths of the wire or strip, one of said work operations comprising tapering a respective blank from a middle portion towards its ends, the remainder of said work operation rendering said blank suitable to be bent into a circlip of the type specified, (b) bending a respective blank accurately around its middle portion on a mandrel so that said blank distorts in a controlled manner to make a circlip of the type specified, with the ends of said blank being shaped into the ends of the circlip and the middle portion of the blank being shaped into the radially thick portion.

Stil further according to the invention there is provided apparatus for making circlips of the type specified comprising means to make a longitudinal blank tapered from its middle portion towards its ends and means to shape the blank so that it is capable of being bent into a circlip of the type specified, a mandrel and bending means adjacent to and co-operable with the mandrel, said bending means being advanceable towards the mandrel to accurately bend the longitudinal blank around the mandrel so that it distorts in a controlled manner into the circlip.

Still further according to the present invention there is provided apparatus for making circlips of the type specified, comprising:

(a) means to perform a series of discrete work operations on integral lengths of, preferably flat, wire or strip to adapt the profile or contour of each successive length of wire or strip in successive stages as the wire is moved relative to work stations of the apparatus at which said operations take place, so that longitudinal blanks are formed successively from successive lengths of the wire or strip, means at one of said work stations to taper each blank from a middle portion of the blank towards its ends and means at the remainder of said work stations to render the blank suitable to be bent into a circlip of the type specified, (b) bending means adjacent and co-operable with a mandrel to bend a respective blank accurately around the mandrel so that it distorts in a controlled manner into the circlip.

By the present invention a longitudinal blank may be made which has a pre-selected contour or profile such that when the blank is bent around the mandrel it assumes a specific desired contour or profile required for the finished precision ring or circlip, usually without need for any further shaping operation.

Usually a circlip of the type specified is designed to fit into a groove with flat parallel sides and so, in that case, the circlip has flat parallel radial faces opposing one another to fit snugly in the groove. In some instances the circlip requires opposing radially inner and outer axial faces of the circlip to be at right angles to the radial faces so that the circlip is of rectangular axial section. Alternatively, in some instances the circlip could be bevelled so that the axial section has five sides and the bevelled face slopes from one of said axial faces to one of the radial faces. The present invention provides for the making of circlips in which the radial faces and axial faces are at a chosen disposition relative to one another. Once a particular contour or profile has been decided upon for the circlip, the precise contour or profile requirement for the blank can be evaluated and the blank made accordingly.

Preferably, the blanks are made from lengths of straight flat wire or strip, and, conveniently, the blanks may be made by a series of operations being performed on long stock, comprising integral lengths of straight wire, along the stock so that at any one time the wire includes blanks at various stages of completion, the finalised blanks being cut off from the long stock before being bent into circlips. However, any alternative method of making the blanks may be used, for example, the blanks could be stamped individually from sheet metal and a series of operations performed, or a number of operations performed simultaneously, on each blank so that each blank is then ready to be bent into a circlip of the type specified.

Preferably, where the blank is made from a length of straight flat wire or strip it is shaped by adapting the profile or contour of the length of wire or strip to form a blank which is capable of being bent into a circlip of the type specified. Adapting the profile or contour may comprise cutting or cropping the length of wire to produce a blank of said tapered form, but with the ends of the length not tapering from the middle portion of the blank. The ends of the length may be formed into circlip ends which are radial lugs. Where the method includes operating on integral lengths of wire or strip such cutting or cropping may be done at a "tapering" work station.

Adapting the profile or contour of the wire may additionally or alternatively comprise shaping the cross-sectional form, for example by operating on opposing first and second faces of the length between the ends thereof to render them non-parallel, e.g. trapezoidal cross-section; the ends my be left flat. Where the method includes operating on integral lengths this shaping of the cross-sectioned form may be done at a "planishing" work station.

In some instances it may be desirable to make circlips from wire or strip of trapezoidal section, and in making a circlip in this case the ends of the length may be flattened before bending instead of shaping the cross-section of wire between the ends. In this way it is possible to form a flat circlip from wire of trapezoidal section.

For circlips which are to fit into grooves with flat parallel sides, non-parallel first and second opposing faces are formed during bending into flat parallel radial faces of the circlip, the length having already been shaped in the preliminary operations to compensate, in an evaluated accurately controlled way, for the distortion effect on opposing first and second faces which arises during bending due to the radial thickness.

To form circlips which are not bevelled, first and second opposing edges of the length are provided which form opposing axial faces of the circlip; said first and second opposing edges are parallel to one another in cross section immediately before the blank is bent into a circlip, and the opposing axial faces of the circlip so formed lie at right angles to the radial faces. To form a bevelled circlip (in particular of the type for internal bores), first and second opposing edges of the length are provided which form opposing axial faces of the circlip and the length may be operated on to provide a bevelled face which is formed into a bevelled face of the circlip during bending.

A hole may be made in each of the ends of the length of wire or strip. Where integral lengths are operated on successively as aforesaid, making a hole in each end of said length may comprise a fourth work operation and two adjacent holes may be made simultaneously in the wire or strip, one hole being made in one end of the length and the other hole being made in an adjacent end of the next successive length.

Said work operations may include forming two notches in the opposed first and second edges of the wire at adjacent ends of successive lengths to provide a web adjoining the ends of the successive blanks made from the lengths, and include also cutting through a web before bending a respective blank into a circlip. Said notches may be made at different work stations.

If preferred, integral lengths of wire or strip may be operated on without moving relatively to work stations, but with the blanks being made or partially completed whilst the lengths of wire or strip are still integral.

The apparatus, preferably, comprises bending means in the form of at least three forming tools, which may be equi-angularly spaced around the mandrel. Four forming tools may be provided. The mandrel is, preferably, generally cylindrical but provided with an axial groove in which the ends of a blank are located after the blank has been formed into a circlip.

The forming tools are, preferably, advanceable and retractable generally radially of the mandrel preferably in synchronised manner and are, preferably, provided with grooves equal to the thickness of the blank. Guide means is, preferably, provided to accurately guide the forming tools when they are advanced or retracted. The forming tools are, preferably, operated pneumatically.

First and second of the forming tools may be similar to one another and each provided with a single curved groove to engage a respective end of a blank being bent into a circlip; a third forming tool, preferaly, has two straight groove portions joined by a generally semi-circular groove so that as a blank is bent into a circlip, part of the blank bends into the semi-circular groove, and the ends of the blank are engaged and shaped by the grooves on the first and second forming tools. A fourth forming tool, if provided, may be arranged to complete the operation of bending the ends of the circlip into their final position.

The apparatus may have guide means to guide a row of integral blanks joined end to end adjacent the mandrel and the third forming tool, and also a cutting blank to sever a blank from the row before it is bent into a circlip. The cutting blade is, preferably, reciprocatable in a plane parallel to the mandrel axis.

Ejector means may be provided to eject a circlip from the mandrel. The ejector means may comprise three pins equiangularly spaced around the mandrel.

To taper a blank, the apparatus, preferably, comprises cropping or cutting means and the blank is, preferably, shaped by compressing the first and second opposing faces between a punch and die. Thus to provide a portion of a flat wire blank with a trapezoidal cross-section, planar opposing faces of the said punch and die may be mutually inclined or angled to one another.

To make a row of blanks formed integrally end to end from flat wire or strip stock, the apparatus, preferably, comprises a blanking tool set comprising an upper blanking tool generally vertically reciprocatable, in use, relative to a lower blanking tool. Said blanking tool set, preferably, provides for a number of the work operations to be carried out successively on a length of wire as it is advanced between the upper and lower tools. Said blanking tool set, preferably, includes means to guide wire between the upper and lower tools and means to guide said upper tool generally vertically downwardly, in use, relative to said lower tool against spring biassing.

An embodiment of method and apparatus for making circlips in accordance with the present invention will now be described, by way of example only, with reference to the accompanying drawings, in which.

Figure 3:
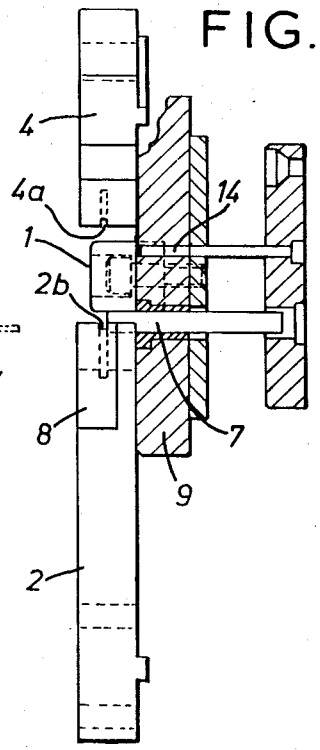
FIG. 3 shows a part sectional side view in the direction of arrow "A" in FIG. 1.
Figure 1:
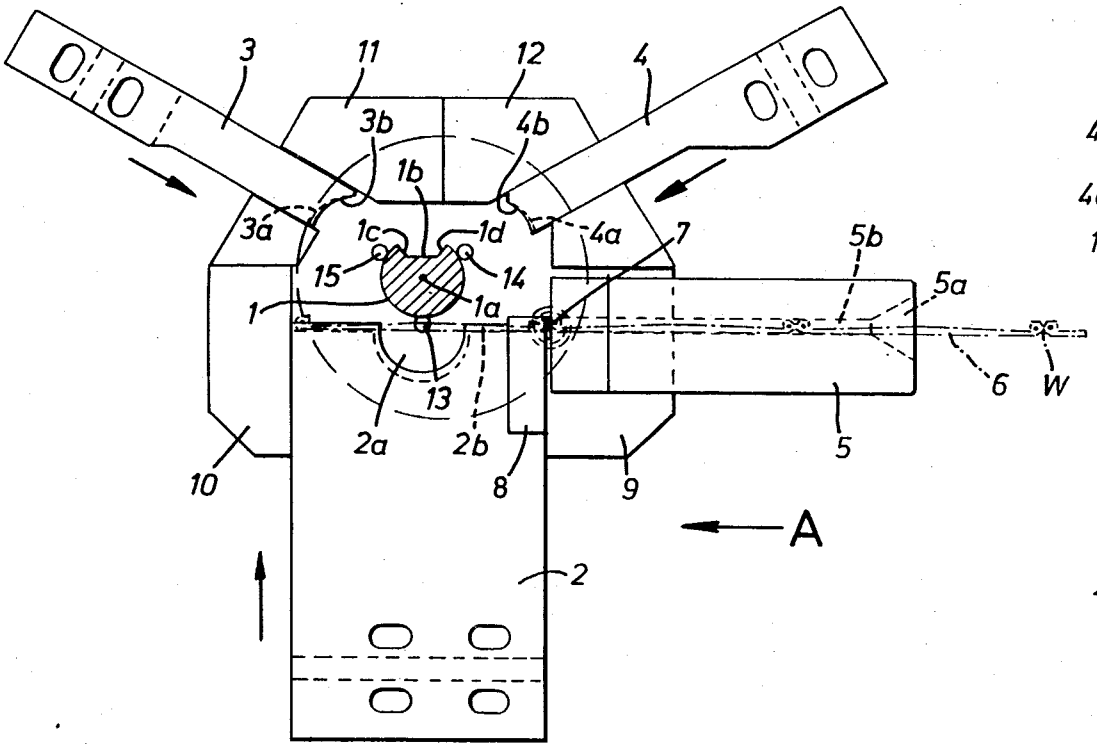
FIG. 1 shows a front view of part of the apparatus including a mandrel and bending means to bend a blank on the mandrel into a circlip of the type specified, the apparatus being illustrated in this example with integral blanks for making "internal" circlips designed to seat in an annular groove within a cylindrical housing body.
Figure 2:
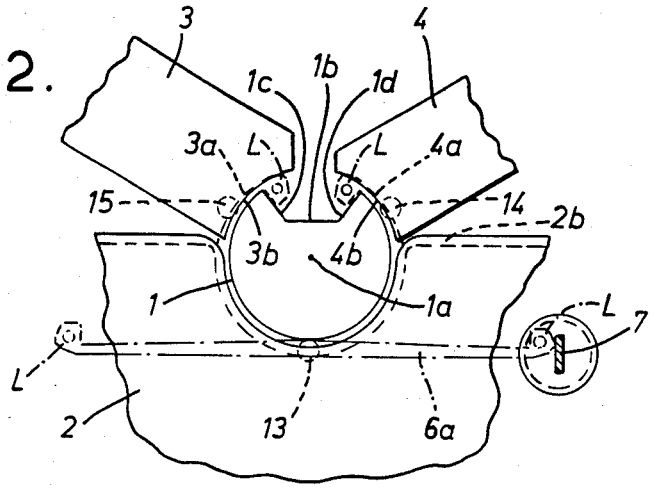
FIG. 2 shows an enlarged detail of FIG. 1 in which the bending means has advanced fully towards the mandrel to complete the bending of a blank into the required form of the circlip.

FIGS. 1 to 3 of the drawings show how longitudinal blanks, integrally joined end to end, may be cut from one another and bent to make circlips of the type specified.

The part of the apparatus shown in FIGS. 1 to 3 represents the final stage in a process or method in which a longitudinal blank tapered from a middle portion towards its ends, and which is of a shape to be bent into a circlip, has already been formed. As shown, a mandrel 1 is surrounded by bending means in the form of three forming tools, 2, 3, 4 equiangularly spaced about the mandrel axis 1*a*. The mandrel 1 is generally cylindrical, but as shown more particularly in FIG. 2, has an upper groove 1*b* with radially inclined sides 1*c*, 1*d* against which the ends L of a blank may be bent over to form a circlip.

Guide means 5 has a diverging inlet mouth 5*a* and a longitudinal channel 5*b* (5*a* and 5*b* shown in dashed lines in FIG. 1) through which a row of integrally joined blanks 6 for circlips for "internal" use are fed from right to left by an operator, or by automatic means. The disposition of the blanks 6 relative to this apparatus stage is shown in FIG. 1 in dashed lines and just prior to bending, a left hand blank 6*a* (see FIG. 2) is cut from the row of blanks 6 by cutting blade 7. Cutting blade 7 is reciprocatable in a horizontal plane, parallel to the mandrel axis 1*a*, and at right angles to the integral row of blanks 6 relative to a cut-off die 8 to cut-off successive blanks one at a time from the row as they are advanced from right to left through the guide means 5. Successive blanks are joined end to end by a narrow-necked web portion W.

Guide blocks 9, 10, 11, 12 are co-operable with the forming tools 2, 3, 4 to guide the tools generally radially inwardly and outwardly of the mandrel. The lower tool 2 is advanceable vertically upwardly and downwardly, and has a horizontal flat top with a central substantially semi-circular depression 2*a* of slightly larger radius than the mandrel 1. A groove 2*b* of thickness equal to the thickness of the row of blanks 6 is provided along the top of tool 2. The blank 6*a* rests in the horizontal parts of the groove 2*b* just prior to bending, with a middle portion of the blank 6*a*, immediately below and radially aligned with the mandrel, and above the semi-circular depression 2*a*. As the tool 2 is guided in blocks 9 and 10 towards the mandrel the middle portion of blank 6*a*, which has a square-cut edge to be bent into the radially inner axial face of the circlip, engages a bottom surface portion of the mandrel 1 and the blank is bent accurately in a controlled manner. Immediately after the middle of blank 6*a* is forced into the depression 2*a* and is bent into a general U-shape, respective ends of blank 6*a* are engaged by tools 3 and 4 which have respective curved tapered grooves 3*a*, 4*a* in curved surfaces 3*b*, 4*b* facing the mandrel 1. Grooves 3*a*, 4*a* are of a thickness equal to the thickness of blank 6*a* which is received therein and the tools 3 and 4 are advanced inwardly in synchronised manner towards the mandrel to complete the bending of blank 6*a* in a controlled manner until reaching the position as shown in FIG. 2. Tools, 2, 3, 4 are then returned to their outward positions relative to the mandrel leaving the completed circlip in the mandrel. Equiangularly spaced, horizontally reciprocatable ejector pins 13, 14, 15 located axially behind the circlip are then advanced forwardly to push the circlip from the mandrel, and the method or process may be repeated to form more circlips in rapid succession. The operation of this part of the apparatus may be controlled by mechanical or pneumatic means.

Although not shown, a fourth, generally vertically reciprocatable tool may be provided opposite forming tool 2, and between tools 3 and 4, which finally finishes the bending operation.

The circlips so formed will of course need to be subjected to subsequent heat treatment and possibly finishing processes such as barrelling or polishing but generally (at least for non-bevelled circlips) no further shaping should be required, this being an important feature of using the present apparatus and method.

Figure 7:
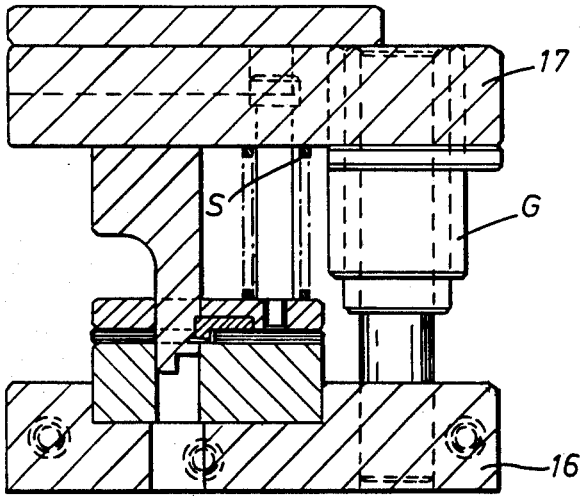
FIG. 7 shows a composite sectional end view on line VII—VII of FIG. 6.
Figure 4:
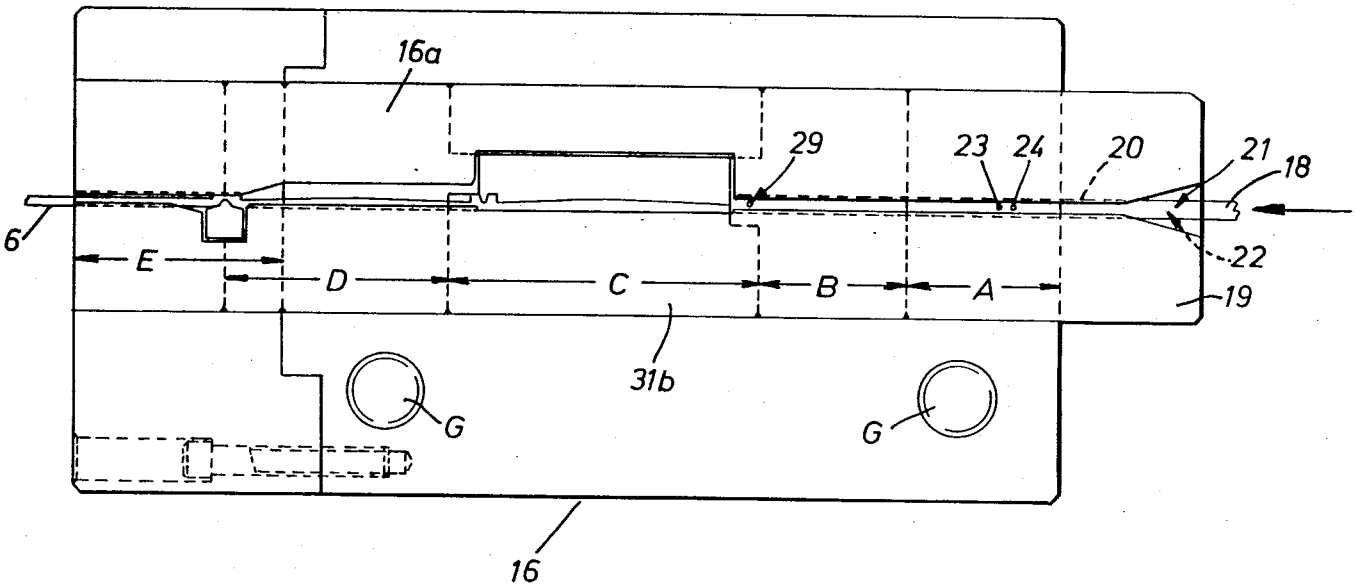
FIG. 4 shows a plan view of a lower blanking tool.
Figure 5:
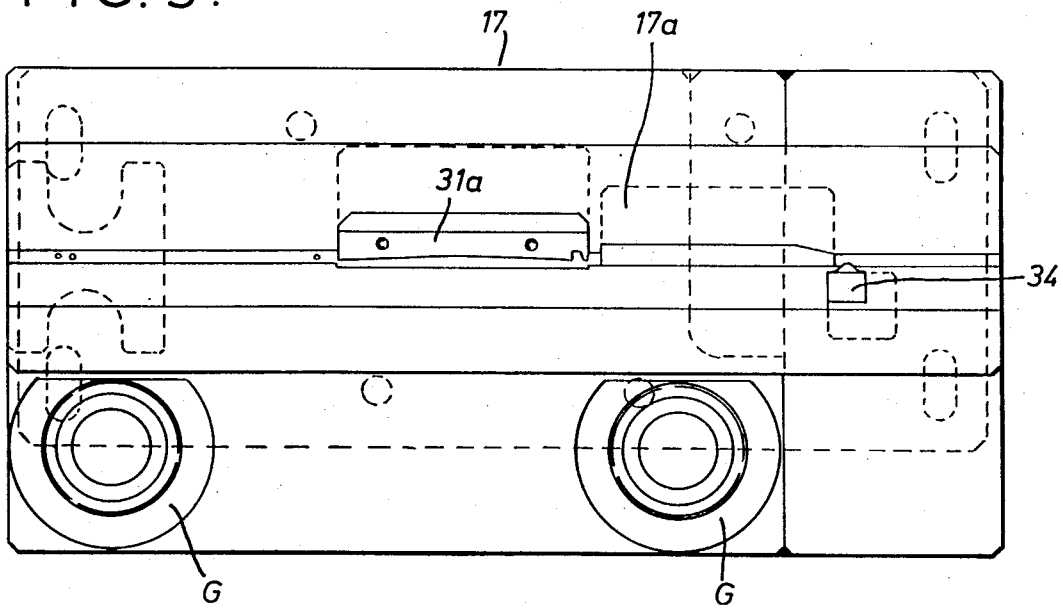
FIG. 5 shows an inverted plan view of an upper blanking tool.

Turning now to making the longitudinal blanks, a lower blanking tool 16 is shown in FIG. 4 which is utilized with an upper blanking tool 17 (see FIG. 5) to perform successive operations on integral lengths or strips of flat wire to make the circlip blanks 6 joined integrally end to end in a row. Flat wire 18 of rectangular section may be fed forwards by a synchronised feed mechanism (not shown) and is guided into the lower tool 16 by guide means 19 through guide slot 20. A series of discrete operations are performed on successive lengths of the wire as it passes through upper and lower tools 17 and 16 until a row of blanks 6 emerges from the left hand end of lower tool 16; each blank is tapered from its middle portion towards its ends and is of a shape suitable to be bent into a circlip of the type specified. As the lengths or strips of wire pass through the upper and lower tools 16 and 17 the profile or contour of each length is adapted in stages to form blanks which are capable of being bent as already described into circlips of the type specified. The lower and upper tools 16 and 17 comprise a blanking tool set such that the upper tool 17 may be moved operatively downwardly relative to the lower 16 on pillar guide means G against spring biassing S (see FIG. 7).

Figure 6:
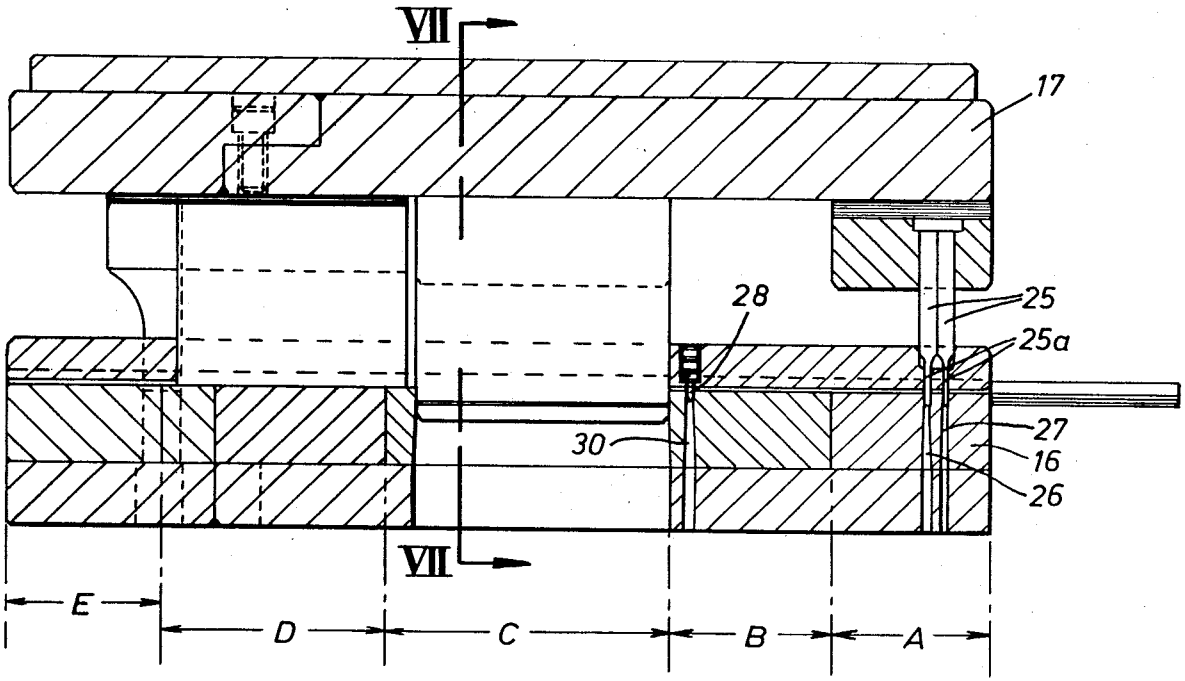
FIG. 6 shows a composite cross-sectional front view of the upper and lower blanking tools located in an operating, down position.
Figure 8:
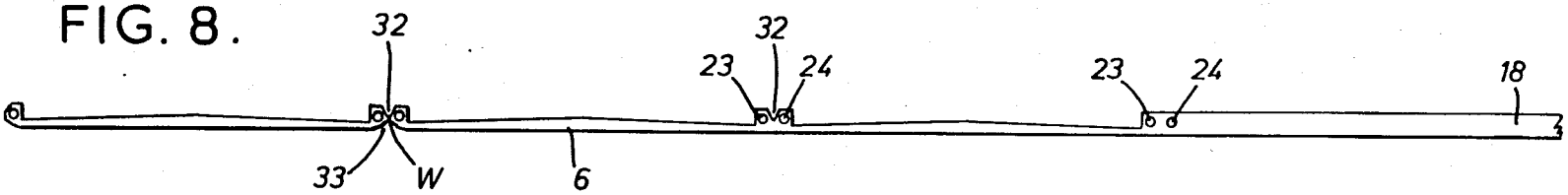
FIG. 8 shows a row of blanks for circlips for internal use in various stages of completion.

A number of work stations A to E are shown in FIGS. 4 and 6 at which work operations take place. Integral lengths of flat wire are fed into tools 16 and 17 with first and second parallel opposing faces 21, 22 lying generally horizontal and first and second edges generally vertical. The first and second opposing faces are eventually formed into flat parallel radial faces of a circlip of the type specified. At work station A, as upper tool 17 is moved operatively vertically downwardly relative to lower tool 16 as shown in FIG. 6, a pair of holes 23, 24 are pierced substantially simultaneously by punch 25 through the flat wire. Bores 26, 27 are provided in the lower tool 16 to locate a piercing portion 25*a* of punch 25. Hole 23 is in one length of the wire which is formed into a blank, and hole 24 is in an immediate successive length which is formed into an immediately successive blank. Similarly in the operative down position, at work station B a pilot pin 28 engages a right hand one of a pair of holes 29 formed previously in the wire at work station A ahead of holes 23, 24, and bore 30 is provided in the lower tool 16 in which the pilot pin 28 is seated. The wire is held at station B by pin 28 whilst a cropping or cutting operation is carried out at work station C just ahead of work station B by crop punch 31*a* of upper tool 17 in co-operation with a lower die 31*b* in lower tool 16. The crop punch 31*a* is shaped to shear out a portion of the first edge of the wire in co-operation with the lower die 31*b* so that the middle of a respective wire length which forms a blank is relatively thick and the length tapers from the middle towards its ends. At the same time a notch 32 (see FIG. 8) is cut, to partially shape adjoining ends of successive blanks between a pair of holes, for example, 23, 24.

Figure 11:
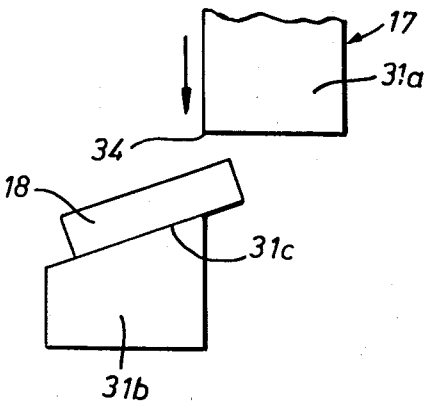
FIG. 11 shows a bevelling operation.
Figure 13:
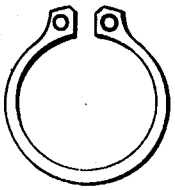
FIG. 13 shows such an external circlip made on the apparatus as shown in FIG. 1, and an apparatus similar to that shown in FIGS. 4 to 7 but with slight modification.

In carrying out the cropping operation on flat wire stock, it is important particularly when making "internal" circlips that the portion sheared out of a length of the wire is removed so as to leave the blank 6 with a square cut planar edge extending in cross-section perpendicular to the original plane of the opposing faces 21 and 22, this being the edge (the "internal" circlips) which subsequently engages against the mandrel during the bending operation. To ensure this result and compensate for a tendency of the upper tool punch 31*a* to be deflected slightly in a lateral direction away from the length of wire during the cropping operation, the supporting surface of the lower die 31*b* may be slightly inclined so that the wire is set obliquely at a small angle to its original transverse axis. FIG. 11 shows diagrammatically how this may be done by providing an upper cutting edge 34 on tool 31*a* co-operable with a lower die 31*b* on tool 16 which has a downwardly inclined edge 31*c* to produce said perpendicular cropped edge on a length of wire during the cropping stage.

Figure 10:
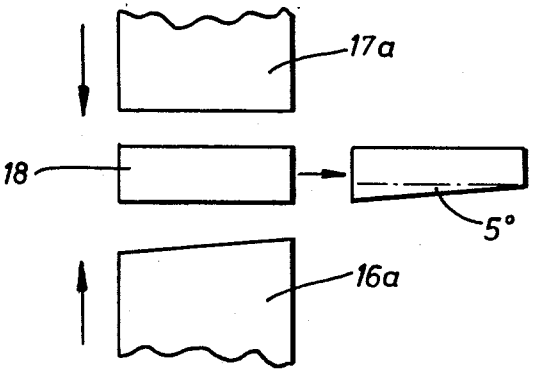
FIG. 10 shows an illustrative detail of shaping a circlip blank.

The next operation to be carried out on a length of wire as it passes between the upper and lower tools 16 and 17 takes place at work station D and is a swaging or shaping operation. Opposing first and second faces 21, 22 of the length at work station D are compressed or planished between lower die 16*a* and punch 17*a* of tools 16 and 17 respectively. As shown in FIG. 10, the planishing punch and die 16*a*, 17*a* respectively have flat, i.e. horizontal, and inclined work faces (this arrangement could be reversed) which shape the cross section of the wire into trapezoidal shape, so that, as seen in cross-section, the first and second faces of a particular length become nonparallel but the first and second opposing edges remain parallel to one another. The first or upper face remains horizontal. The second or lower face is inclined at about 5° to the horizontal and the length is thickest at the first or uncropped straight edge, so that when a blank is bent into a circlip as described in relation to FIGS. 1 to 3 the first and second opposing faces will be formed into flat parallel radial faces of the circlip. During the swaging or shaping stage the ends of the length L which are not tapered are left flat. Instead of the punch 17*a* having a flat work face as shown both work faces could be inclined to produce a cross section symmetrical about the transverse axis, with the first and second faces being inclined, preferably, at an angle of 2.5° to the horizontal.

The next successive work operation to be carried out on a particular length of wire is at work station E where a notch 33 is cut into the second edge by notch punch 34 between two adjacent successive lengths and opposed to notch 32. This operation leaves the web W between the blanks which is later sheared through before a blank is bent into a circlip as described in relation to FIGS. 1 to 3. Additionally, where tools 16 and 17 are used with the mandrel and bending means in the orientations described, a twist operation is necessary to turn the row of blanks through 90° before being bent around the mandrel. This may be done by providing an extra twist stage on tools 16 and 17 or may be provided for automatically by the guide slot 5*b* as the row of blanks is introduced into the guide means 5. The notch 33 may provide means for locating blades during cutting and may also assist in localising the twist operation. Also additionally where it is desired to make an "internal" circlip of the type specified but with a bevelled face an additional work operation may be carried out by tools 16 and 17 being appropriately adapted.

Figure 9:
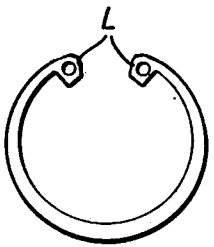
FIG. 9 shows an internal circlip as produced by the illustrated apparatus of this embodiment.

FIG. 9 shows a typical circlip of the type specified, designed for internal use, as may be made by the apparatus and method described. It will be noted that the radial faces are planar and parallel and the circlip is of smooth continuous tapered appearance between the middle portion and ends L (which are flat radial lugs), without irregularity in the radially inner and radially outer curved profiles. It has a substantially rectangular cross-section throughout.

In the particular embodiment described, the radial faces are parallel although the corresponding faces of the blank were not so just prior to bending. Trying to form a circlip as shown in FIG. 9 without shaping the blank correctly, for example by leaving said first and second opposing faces parallel, results in a circlip having an unsatisfactory shape which does not conform to that of the type specified, since multiple irregularities would occur in bending the blank which would distort the shape causing buckling and detracting from a smooth continuous tapered appearance or profile between the middle portion and the ends. In contrast, it will be appreciated that in carrying out the present invention as described, in effect the blank is deliberately pre-shaped to conform to a particular profile, including a characteristic tapering or trapezoidal cross-sectional configuration, chosen to allow for and compensate in respect of the distortion, especially cross-sectional distortion, to be expected and predicted in carrying out the bending operation on the mandrel. In most cases this enables a circlip of the proper shape to be formed solely by the bending of the blank on the mandrel without need for any subsequent shaping.

Figure 12:
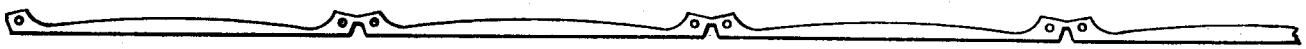
FIG. 12 shows a row of blanks for circlips for external use designed to seat in an annular groove on shaft.

FIG. 12 shows a row of integral blanks for "external" circlips which may be formed in similar manner to that described for "internal" circlips with suitable modification of the blanking tool set 16, 17. Such a modified tool set should be readily envisaged from the aforegoing description and, therefore, will not be described in detail.

The apparatus shown in FIGS. 1 to 3 may be used for "external" circlips without modification to any of the forming tools. An important difference in forming an "external" circlip rather than an "internal" one is that the edge which contacts and is bent around the mandrel is, in fact, the uncropped straight edge of the length of wire. Therefore, to form a bevelled circlip for "external" use, since the bevelled face joins the radially innermost axial face of the circlip, the bevelled face would have to be formed after the bending operation. This is because the edge of the blank which contacts the mandrel needs to be substantially square cut rather than inclined. The bending operation is unaffected by the slight rounding which is characteristic on flat wire stock.

A difference which does not occur in making "external" circlips is that due to the forces involved in bending the circlip and the material involved and the end recoil on release, the minimum gap between the end is slightly larger than the gap which is usual throughout the United Kingdom. This does not present any problem and indeed it is already common in some countries for external circlips to have a similar gap.

For the avoidance of doubt the term "flat wire or strip" when used throughout the description and claims refers to wire or strip of substantially rectangular cross section.

I claim:

1. A method of making circlips having a planar, generally annular ring section with a gap defining two free ends of the ring section, and a radially thick portion diametrically opposite the gap, the circlip diminishing in radial thickness from the radially thick portion toward the free ends to yield a smooth, continuous tapered appearance between the ends and said thick portion, said method comprising the steps of:

(a) making a longitudinal blank including a middle portion and two ends and being tapered from its middle portion toward its ends and having a shaped structural configuration to be formed into a said circlip by bending the blank, (b) providing a mandrel around which the blank may be bent, and (c) bending the blank accurately around its middle portion on said mandrel to distort the blank during the bending operation in a controlled manner to make said circlip with the ends of the blank being shaped into the ends of the circlip and the middle portion of the blank being shaped into the radially thick portion of the circlip.

2. A method as defined in claim 1 wherein the blank is made from a length of wire or strip and shaped by configuring the profile or contour of the length of wire or strip to form a blank which is capable of being bent to make said circlip, and the configuring of the profile or contour comprises cutting or cropping the length of wire or strip to produce a blank of said tapered form but with the ends of the length not tapering from the middle portion of the blank.

3. A method as defined in claim 2 wherein the length of wire or strip is flat having opposing faces and opposing edges, and the configuring of the profile or contour of the wire or strip comprises shaping the cross-sectional form by operating on opposing first and second faces of the length between the ends thereof to render them non-parallel with the ends left flat, the first and second opposing faces of the wire or strip length being formed during bending into flat parallel radial faces of the circlip, the first and second opposing edges of the wire or strip length form opposing axial faces of the circlip, said first and second opposing edges are parallel in cross-section to one another immediately before the blank is bent into a circlip, and the opposing axial faces of the circlip so formed lie at right angles to the radial faces.

4. A method of making circlips having a planar, generally annular ring section with a gap defining two free ends of the ring section, and a radially thick portion diametrically opposite the gap, the circlip diminishing in radial thickness from the radially thick portion toward the free ends to yield a smooth, continuous tapered appearance between the ends and said thick portion, said method comprising the steps of:

(a) providing a plurality of work stations along a path, (b) moving lengths of wire or strip along said path, (c) performing a series of discrete work operations on the lengths of wire or strip to configure the profile or contour of each successive length of wire or strip in successive stages as the wire or strip is moved relative to the work stations at which said operations take place, so that longitudinal blanks are formed successively from successive lengths of the wire or strip, (d) one of said work operations comprising tapering a respective blank from a middle portion thereof toward its ends with the remainder of said work operations rendering said blank suitable to be bent into said circlip, and (e) providing a mandrel around which the blank may be bent, and (f) bending a respective blank accurately around its middle portion on said mandrel to distort said blank in a controlled manner to make a said circlip, (g) the free ends of said blank being shaped into the ends of the circlip and the middle portion of the blank being shaped into the radially thick portion thereof.

5. A method as defined in claim 4 wherein said work operations include forming two notches in opposed first and second edges of the wire or strip at adjacent ends of successive lengths to provide a web adjoining the ends of successive blanks made from the lengths and cutting through the web before bending one of the blanks into a said circlip.

6. Apparatus for making circlips having a planar, generally annular ring section with a gap defining two free ends of the ring section, and a radially thick portion diametrically opposite the gap, the circlip deminishing in radial thickness from the radially thick portion toward the free ends to yield a smooth, continuous tapered appearance between the ends and said thick portion, said apparatus comprising:

(a) means to make a longitudinal blank which is tapered from its middle portion toward its free ends, (b) means to shape the blank so that it is capable of being bent into a said circlip, (c) a mandrel and bending means adjacent to and co-operable with the mandrel, (d) said bending means being advanceable toward the mandrel to accurately bend the longitudinal blank around the mandrel to distort the wire in a controlled manner into said circlip.

7. Apparatus as defined in claim 6 wherein the bending means includes at least three forming tools equiangularly spaced around the mandrel, the mandrel is generally cylindrical, and the forming tools are advanceable and retractable in synchronized manner generally radially of the mandrel.

8. Apparatus as defined in claim 7 wherein first and second of the forming tools are similar to one another and each include a single curved groove to engage a respective end of a blank being bent into a circlip, and a third forming tool has two straight groove portions joined by a generally semi-circular groove so that as a blank is bent into a circlip, part of the blank bends into the semi-circular groove, the ends of the blank are engaged and shaped by the grooves on the first and second forming tools, said blank making means including cropping or cutting means to taper a blank, and a punch and die for compressing first and second opposing faces of the blank, said punch and die having planar opposing faces mutually inclined or angled to one another.

9. Apparatus for making circlips having a planar, generally annular ring section with a gap defining two free ends of the ring section, and a radially thick portion diametrically opposite the gap, the circlip diminishing in radial thickness from the radially thick portion toward the free ends to yield a smooth, continuous tapered appearance between the ends and said thick portion, said apparatus comprising:

(a) means forming a plurality of work stations along a path, (b) means for moving lengths of flat wire or strip along said path, and (c) means to perform a series of discrete work operations on the lengths of flat wire or strip to configure the profile or contour of each successive length of wire or strip in successive stages as the wire or strip is moved relative to the work stations at which said operations take place, so that longitudinal blanks are formed successively from successive lengths of the wire or strip, (d) means at one of said stations to taper each blank from a middle portion of the blank toward its ends, (e) means at the remainder of said work stations to render the blank suitable to be bent into a said circlip, (f) a mandrel, and (g) bending means adjacent and co-operable with the mandrel to bend a respective blank accurately around the mandrel to distort the wire or strip in a controlled manner into the circlip.

* * * * *